US009254233B2

(12) United States Patent
Schy

(10) Patent No.: US 9,254,233 B2
(45) Date of Patent: Feb. 9, 2016

(54) APPARATUS FOR LIFTING PERSONS

(71) Applicant: Robert Schy, Apple Valley, UT (US)

(72) Inventor: Robert Schy, Apple Valley, UT (US)

( * ) Notice: Subject to any disclaimer, the term of this patent is extended or adjusted under 35 U.S.C. 154(b) by 0 days.

(21) Appl. No.: 13/958,493

(22) Filed: Aug. 2, 2013

(65) Prior Publication Data

US 2015/0035333 A1 Feb. 5, 2015

(51) Int. Cl.

| | |
|---|---|
| ***A47C 1/00*** | (2006.01) |
| ***A61G 7/10*** | (2006.01) |
| *A61G 5/10* | (2006.01) |

(52) U.S. Cl.

CPC ..... *A61G 7/1011* (2013.01); *A61G 7/103* (2013.01); *A61G 7/1019* (2013.01); *A61G 7/1059* (2013.01); *A61G 5/1059* (2013.01); *A61G 7/1046* (2013.01)

(58) Field of Classification Search

CPC ..... A61G 7/10; A61G 7/1001; A61G 7/1011; A61G 7/1038; A61G 7/1019; A61G 7/103; A61G 5/1059; A61G 7/1059; A61G 7/1046

USPC ..... 297/344.12, 344.18, 344.2; 5/83.1, 5/86.1, 87.1

See application file for complete search history.

(56) References Cited

U.S. PATENT DOCUMENTS

| | | | | | |
|---|---|---|---|---|---|
| 2,962,730 | A * | 12/1960 | Carnes et al. | ..... | 5/86.1 |
| 4,399,572 | A * | 8/1983 | Johansson | ..... | 5/87.1 |
| 5,333,333 | A * | 8/1994 | Mah | ..... | 5/87.1 |
| 6,430,761 | B1 * | 8/2002 | Brandorff et al. | ..... | 5/86.1 |
| 6,941,595 | B1 * | 9/2005 | Michael | ..... | 5/83.1 |
| 7,611,203 | B1 * | 11/2009 | Roberts et al. | ..... | 297/344.2 |
| 7,716,759 | B2 * | 5/2010 | Wilder | ..... | 5/83.1 |
| 2010/0287698 | A1 * | 11/2010 | Stryker | ..... | 5/87.1 |

* cited by examiner

*Primary Examiner* — Philip Gabler
(74) *Attorney, Agent, or Firm* — Riel Law; Jennifer Riel

(57) ABSTRACT

An apparatus to lift persons includes: a base; wheels attached to the base; a vertical assembly including a fixed subassembly and a traveling subassembly; a mechanism such as an actuator that powers vertical movement of the traveling subassembly; a fork system attached to the traveling subassembly and comprises a pair of forks; and a substantially flat seat plate that is removably attached to the fork system and includes a pair of channels along opposite sides of the seat plate. The seat plate is removed from the fork system, placed onto the floor, and is then mounted by a person. The seat plate is reattached to the fork system by inserting the forks into the channels, and the actuator is activated to lift the person from the floor. The base and fork system may be pivotally attached to the fixed subassembly and traveling subassembly, respectively, so that the apparatus is collapsible.

20 Claims, 14 Drawing Sheets

APPARATUS FOR LIFTING PERSONS

FIELD OF THE INVENTION

The present invention relates generally to apparatuses and devices that assist physically impaired persons. More particularly, the present invention relates to an apparatus that lifts and moves persons who are physically unable to get up on their own from the ground.

BACKGROUND

As our average lifespan increases and people live longer and longer, the elderly population in America and throughout the world continues to grow. In 2009, there were 39.6 million elderly people (aged 65 and over) in America, comprising 12.9% of the population. This group grows each year, and is projected to reach 72.1 million people (19% of the U.S. population) by 2030.

A record number of elderly people need some form of assistance, and are cared for in nursing homes, assisted living facilities, hospitals, or other elderly care facilities, while many are cared for in their own homes or in homes of family members. In 2004, over 1.5 million Americans resided in nursing homes. About 3.2 million Americans resided in a nursing home at some time in 2008. As of 2010, there were approximately 16,639 assisted-living facilities in the U.S., with 1,736,645 beds. And, as the "baby boomer" generation continues to age, these numbers are projected to increase over time.

Additionally, according to the 2010 U.S. Census, there are about 56.7 million people in America (18.7% of the population) living with a disability of some kind, with 38.3 million of those people suffering from a "severe" disability. Many of these people suffer from physical disabilities and need assistance in their daily lives, or are physically unable to perform various tasks. Furthermore, many individuals suffer temporary physical impairments from accidents, and these people also require the assistance of healthcare professionals or family members to perform daily tasks.

Among the elderly and disabled population, falls are a common and dangerous risk. While many of us have seen the LIFE ALERT® commercials showing elderly people saying, "I've fallen and I can't get up," the problem is a real and serious one for many elderly and disabled people. Each year, one in every three adults aged 65 and over falls, for a total of 2.3 million non-fatal fall injuries for the elderly population in 2010, requiring 662,000 hospitalizations. In fact, falls are the leading cause of injury death for this segment of the population. These falls may cause injuries such as hip fractures, head injuries, bruises, or broken bones. Once on the ground, many people are unable to safely stand up again on their own, due to infirmary, injury, lack of balance, or many other possible factors. Many people will need assistance to rise into a sitting or standing position. If there is a relative or caregiver nearby, they can assist the fallen person to stand. However, helping an elderly or disabled person to stand can take a great deal of strength and is dangerous even for a healthy caregiver. In fact, there are more musculoskeletal injuries to health care workers than steelworkers and construction workers combined. Often, nurses or other caregivers will simply lean over the fallen patient and attempt to help pull them up with their arms, often resulting in back injuries or other problems.

Nursing advocacy groups, including the American Nursing Association, have put forth considerable effort to educate hospitals, nursing homes, and health care workers about the dangers of manually lifting fallen patients, and have developed Safe Patient Handling and Movement (SPH&M) programs. However, there is resistance to these programs by some care facilities due to the fact that the mechanical lifting aids currently on the market require a great deal of time, effort, and training to safely implement. Existing mechanical lifting aids currently on the market take from three to six minutes to move a fallen patient. However, use of some form of lifting aid has been shown to improve caregiver and patient safety, while preventing additional falls.

Due to the incidence of patients falling, and the dangers in trying to lift them up without assistance, there is a clear need for devices and apparatuses that can safely assist fallen people to stand up again, without risking further injury to either the patient or the caregiver.

Types of Patient Lifts Currently Existing in the Art

The most common patient lifts currently existing in the art are various types of sling lifts (sometimes referred to as the HOYER® Lift which is the most common brand name) that comprise of legs at the bottom that form a wide base, a crane-like structure extending upwards, and a sling or straps in which the patient can sit. These lifts were derived from the "cherry-picker" lifts used in automotive shops to lift and move engines and other heavy automotive parts.

Another common type of patient lift in common use in nursing homes today are various types of inflatable patient lifts. These work usually by sliding a collapsed air bladder underneath the patient, positioning the patient properly in the center of the air bladder, and then inflating the air bladder to raise the patient to a higher position, or into a sitting position. These inflatable lifts are similar to air-inflated mattresses and usually require an electronic air compressor and one or more tubes to pump air into the device with sufficient force to pressurize the air bladder and move the disabled patient.

Drawbacks and Potential Improvements

The currently-existing patient lifting devices each suffer from serious flaws that make them large and unwieldy, unsteady, slow to use, and difficult for one caregiver to operate. Many manufacturers of mechanical patient lifts suggest or require that two caregivers be present to operate the lift, which is not always cost-effective or possible, especially in home health care settings. Additionally, many devices currently on the market require a higher degree of patient mobility and strength than the patient may possess, considering they have just suffered a fall and are weak, injured, or disabled enough to require assistance to stand back up in the first place.

For example, the sling lifts currently existing in the art are large and bulky, and many do not collapse for ease of storage and transport. Additionally, due to their nature of having a sling or series of straps suspended from a crane-like extension, they are often unstable, swinging side to side and backwards and forwards as the patient is placed in them and their weight shifts around. This swinging can cause disorientation, nausea, further injury from impacts on the metal frame of the device itself or nearby walls or furniture, and even injury from the patient falling out of the apparatus. Further, these sling-type devices often require a great deal of strength and effort from the caregiver to operate (increasing the risk of caregiver injury), and some even require more than one caregiver to operate, which may not be possible or cost-effective in many situations. It can also be difficult to get the sling or straps underneath a prone or immobile patient, which is required in order to use these types of devices. The straps or sling material are usually porous, and are more likely to transmit infections and diseases when used for multiple patients (such as in a hospital or assisted living facility setting), and thus they may need to be disinfected or discarded, increasing time and expense.

The inflatable lifting devices currently existing in the field also suffer from a number of drawbacks and problems. Similar to the sling lifts described above, inflatable air mattresses are also somewhat unstable, especially as they are being inflated, before they achieve maximum air pressure (even then, they are less stable than rigid surfaces). Due to this instability, use of inflatable lifting devices requires a great deal of training and care on the part of the caregiver for proper positioning and weight distribution of the patient, especially for patients who may be disoriented or alarmed and who move or shift during the inflation or lifting process. These types of inflatable devices must be adjusted to each individual patient based on their size, shape, and weight to make sure the patient is positioned properly and to not exceed the weight limits of the apparatus. In order to use these devices, (i) the patient must often be rolled (which could be problematic or impossible due to patient injuries or lack of space in the area where they fell), (ii) the apparatus is then slid beneath the patient, (ii) the patient is then rolled back onto the apparatus and slid, pushed, or pulled into the proper balanced position in the center of the apparatus. This movement may be difficult for a caregiver to perform (and may lead to straining or caregiver injury), may require external slide sheets or other positioning aids, may injure the patient or exacerbate new or existing injuries, and may cause discomfort or alarm to patients who are confused, in pain, or afflicted with dementia. Due to these factors, such inflatable systems require a great deal of time to unpack, set up, slide underneath the patient, position properly, and inflate; and often patients are disoriented, agitated, or have injuries from their recent fall that require prompt treatment. These inflatable air bladders are also made of materials that may harbor infection or disease, and therefore need to be sterilized between uses.

Accordingly, there is a need in the art for a patient lifting system that is: compact in size so that it can be used in health care facilities and homes where there is limited space; collapsible to save space and for easy storage; simple to operate so as not to require a great deal of specialized training; easy to use by a single caregiver of average or below-average strength to avoid caregiver injury; made entirely of hard surfaces and are not prone to spreading infection and is thus more sanitary; easy to position and slide underneath the patient to position the patient properly to be lifted; is simple and quick to operate without complicated set-up or positioning; and is stable throughout the positioning and lifting process. However, the present invention possesses each of these characteristics, and therefore fulfills a need in the art. Other advantages of the present invention will be apparent to one of ordinary skill in the art in light of the ensuing description of the present invention.

SUMMARY

The present invention is directed to an apparatus that lifts and moves a disabled, injured, or elderly person who is unable to get up from the ground without assistance. The present invention is comprised of hard, rigid surfaces that allow easy positioning and mounting of the patient, provide stability during the patient positioning and lifting process, and are not prone to spreading bacteria or other microorganisms. The invention minimizes the risks of caregiver injury since it can easily and efficiently be used by one caregiver who is unable to lift and/or move a patient on his or her own. The apparatus of the present invention is simple and quick to operate without requiring extensive caregiver training or complicated set-up or positioning. Furthermore, the apparatus of the present invention is collapsible for easy storage and transport and has a small footprint so it can be used in healthcare facilities and homes with limited space.

To achieve the foregoing and in accordance with the purposes of the present invention, the present invention is directed to a lift apparatus that generally includes: (a) a base which includes at least two legs; (b) a plurality of wheels attached to the base; (c) a vertical assembly including (i) a fixed subassembly which stays fixed while the patient is elevated or lowered and (ii) a traveling subassembly that is attached to a fork system; (d) a mechanism that powers the vertical movement of the traveling subassembly; (e) a fork system including a first fork and second fork that extend horizontally from the vertical assembly; and (e) a flat seat plate that is removably attached to the fork system and includes a pair of parallel channels that run along the seat plate's sides wherein the forks are inserted inside the channels when the seat is attached to the fork system. The mechanism that facilitates the vertical movement of the traveling subassembly may comprise of a manual winch and cable. Alternatively, the mechanism can comprise of an actuator that includes (i) a moving block or carriage mounted to the traveling subassembly, (ii) a track to which the carriage is moveably engaged, and (iii) a motor that powers the vertical movement of the carriage upon the track to lift the seat plate from the floor to a higher elevation. The actuator may be controlled by a remote control that may be removably attached (e.g., via VELCRO®) to an accessible position on the vertical assembly, or the actuator can be controlled by a control panel (e.g., switches and/or buttons located on the vertical assembly).

In one embodiment of the invention, a lift apparatus comprises: (a) a base that includes a first leg, a second leg, and a crossbeam connected to the first leg and the second leg; (b) a plurality of wheels attached to the base; (c) a vertical assembly comprised of (i) a fixed subassembly that is adjoined to the base and includes a first vertical member, a second vertical member parallel to the first vertical member, and a top crossmember connected perpendicularly to the first vertical member and second vertical member, and (ii) a traveling subassembly moveably mounted onto the fixed subassembly; (d) a mechanism that facilitates vertical motion of the traveling subassembly; (e) a fork system that is attached to the traveling subassembly, extends horizontally from the traveling subassembly, and includes a first fork and a second fork parallel to one another; and (f) a seat plate that is substantially flat, removably attached to the fork system, and includes a first channel positioned along one side and a second channel that is parallel to the first channel and positioned on the opposite side of the first channel.

The seat plate is removed from the fork system and placed onto the floor to allow the person on the floor to mount the seat plate. Unlike other devices in the art, the person can mount the seat plate from a position behind the seat plate (i.e., the person mounts the seat plate from his/her front side). Additionally, the person can mount the seat plate from a position in front of the seat plate (i.e., the person mounts the seat plate from his/her backside as for example, by maneuvering and scooting backward onto the seat plate). The rigidity, flatness, and smooth surface of the seat plate allows it easily to be placed underneath the person during the mounting process. After the person mounts the seat plate, it is then reattached to the fork system by inserting the first fork into the first channel and by inserting the second fork into the second channel, and the mechanism is then activated to lift the person from the floor.

In some embodiments, the traveling subassembly includes a first sidebar, a second sidebar parallel to the first sidebar, a lower crossbar connected perpendicularly to the first sidebar and second sidebar, and an upper crossbar connected perpendicularly to the first sidebar and second sidebar. The fork system may be pivotally attached to the traveling subassembly, and the lift apparatus is collapsed (when the seat plate is attached to the fork system) by rotating the seat plate from a horizontal position to a vertical position (e.g., the seat plate is flipped or rotated upward to a position against the vertical assembly). Furthermore, the base may be pivotally adjoined to the fixed subassembly, and the lift apparatus is further collapsed by rotating the base from a first position parallel to the floor to a second position parallel to the vertical subassembly (e.g., the base may be rotated downward and backward such that the second position of the base is against the backside of the vertical assembly). In an alternate version of the invention, the mechanism may be comprised of a manual winch and a cable, or it may comprise of an actuator such as a linear actuator that includes a motor, a track, and a carriage that is moveably engaged with the track. The actuator may be controlled by a wired or wireless remote control or by a control panel located on the lift apparatus.

In an additional embodiment of the present invention, an apparatus for lifting a person from a floor comprises: (a) a base including a first leg, a second leg parallel to the first leg, and a crossbeam connected perpendicularly to the first leg and second leg; (b) a plurality of wheels attached to the base; (c) a vertical assembly comprised of (i) a fixed subassembly that includes a first vertical member, a second vertical member parallel to the first vertical member (wherein the base is pivotally adjoined to the first vertical member and the second vertical member), and a top crossmember connected perpendicularly to the first vertical member and second vertical member, and (ii) a traveling subassembly that is moveably mounted onto the fixed subassembly and includes a first sidebar, a second sidebar parallel to the first sidebar, a lower crossbar connected perpendicularly to the first sidebar and second sidebar, and an upper crossbar connected perpendicularly to the first sidebar and second sidebar; (d) a mechanism that facilitates vertical motion of the traveling subassembly; (e) a fork system that is pivotally attached to the traveling subassembly, extends horizontally from the traveling subassembly, and includes a first fork and a second fork parallel to the first fork; and (f) a seat plate that is substantially flat, removably attached to the fork system, and includes a first channel positioned along one side of the seat plate and a second channel positioned parallel to and opposite the first channel. The seat plate is removed from the fork system and placed onto the floor to allow the person on the floor to mount the seat plate. After the person mounts the seat plate, it is then reattached to the fork system by inserting the first fork into the first channel and by inserting the second fork into the second channel, and the mechanism is then activated to lift the person from the floor. The apparatus may then be collapsed by rotating the seat plate and the base from horizontal positions to vertical positions. For example, to collapse the apparatus, the seat plate (when attached to the fork system) may be rotated upward to reposition it from a horizontal position (on which the user sits) to a vertical position that lies against the front side of the vertical subassembly. To further collapse the apparatus, the base may be rotated and swung downward to reposition the base against a backside of the vertical assembly.

In some variations of the foregoing embodiment, the fixed subassembly may further include a lower crossmember connected perpendicularly to the first vertical member and second vertical member, and the traveling subassembly may further include a mount affixed to the upper crossbar. The mechanism that facilitates the vertical movement of the traveling subassembly may comprise of a linear actuator such as one that includes a motor, a track, and a carriage moveably engaged with the track wherein the motor is attached to the lower crossmember and the carriage is fastened to the mount. Also, the apparatus may further include a strap that is affixed to the seat plate. The user can hold onto this strap for stability and a sense of security while he/she is being lifted from the floor.

The above description sets forth a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in further detail, it is to be understood that the invention is not limited in its application to the details of the construction and to the arrangement of the components set forth in the following description or as illustrated in the drawings. The invention is capable of other embodiments and of being practiced and carried out in various ways. Furthermore, it is to be understood that the phraseology and terminology employed herein are for the purpose of description and should not be regarded as limiting.

Other features, aspects, and advantages of the present invention will become apparent from the following description of the invention, taken in conjunction with the accompanying drawings, which illustrate, by way of example, various features of embodiments of the invention.

DESCRIPTION OF THE INVENTION

Figure 1:
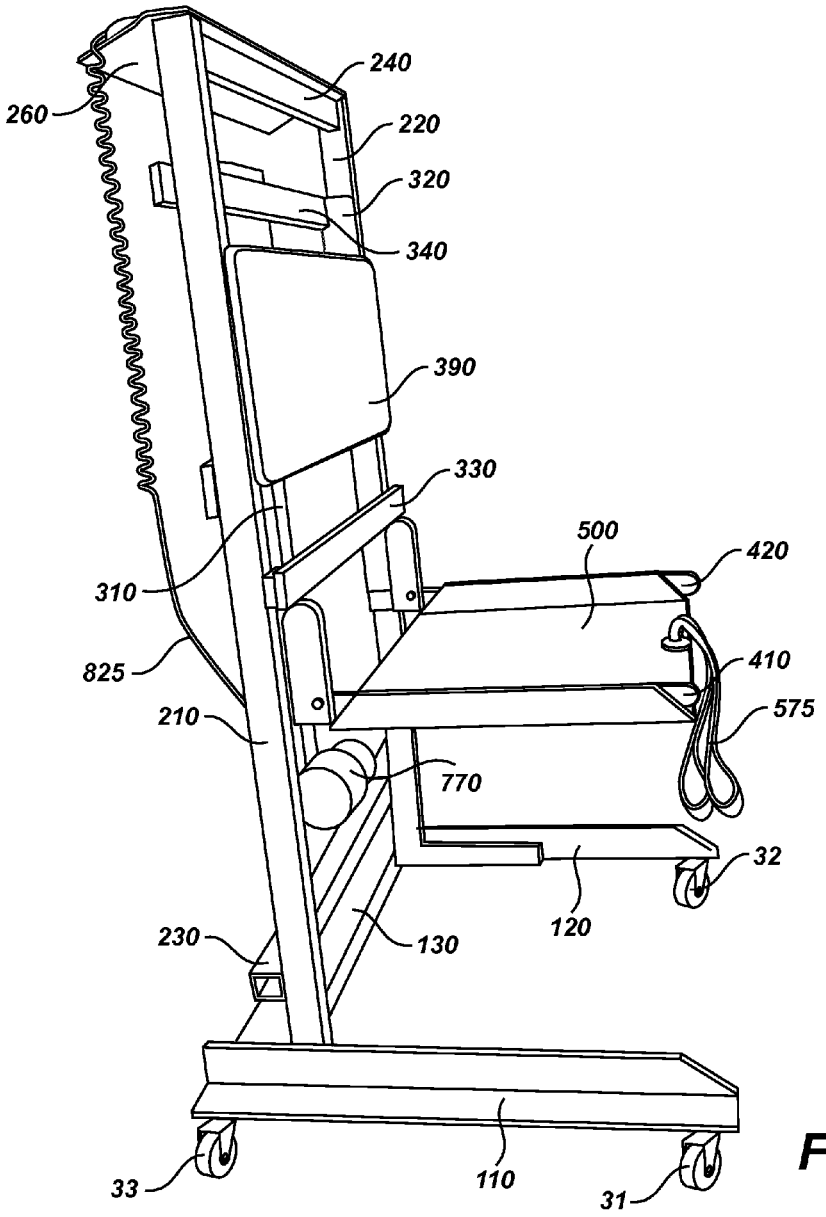
FIG. 1 depicts a perspective view of a lift apparatus with the seat plate in an elevated position in accordance with an embodiment of the present invention.

In the following description of embodiments of the invention, reference is made to the accompanying drawings, which form a part of this application. The drawings show, by way of illustration, certain embodiments in which the invention may be practiced. It is to be understood that other embodiments may be utilized and modifications may be made without departing from the scope of the present invention. Also, it is to be understood that the phraseology and terminology employed herein are for the purpose of description and should not be regarded as limiting.

For ease of reference, the following reference numbers are consistently used in the accompanying drawings of the present application to depict various components and embodiments of the present invention.

REFERENCE NUMBERS

31 wheel
32 wheel
33 wheel
34 wheel
61 position glide
62 position glide

Base

110 first leg
120 second leg
130 crossbeam
160 pivot arm
162 bolt
164 nut

Fixed Subassembly of Vertical Assembly

210 first vertical member
220 second vertical member
230 lower crossmember
240 top crossmember
260 top member

Traveling Subassembly of Vertical Assembly

310 first sidebar
315 bottom of first sidebar
320 second sidebar
325 bottom of second sidebar
330 lower crossbar
340 upper crossbar
350 mount
372 first fork outer mount
374 first fork inner mount
376 second fork outer mount
378 second fork inner mount
390 front panel

Fork System

410 first fork
420 second fork
442 locking nut
462 bolt
476 second fork outer washer
478 second fork inner washer

Seat System

500 seat plate
510 first channel
520 second channel
575 strap

Actuator

730 carriage
750 track
770 motor
825 cord
880 remote

Lift Apparatus

The present invention is directed to a lift apparatus that generally comprises: (a) a base; (b) a plurality of wheels attached to the base; (c) a vertical assembly including (i) a fixed subassembly (which stays fixed while the patient is elevated or lowered) and (ii) a traveling subassembly (which travels along with the fork system to which it is attached and the seat plate that is attached to the fork system) while the patient is elevated or lowered; (d) a mechanism such as an actuator or mechanical winch that powers the vertical movement of the traveling subassembly; (e) a fork system that extends horizontally from the vertical assembly; and (e) a flat seat plate that is removably attached to the fork system. The seat plate includes a pair of parallel channels that run along the seat plate's sides wherein the forks of the fork system are inserted into the channels when the seat plate is attached to the fork system and thereby attached to the lift apparatus.

Figure 2:
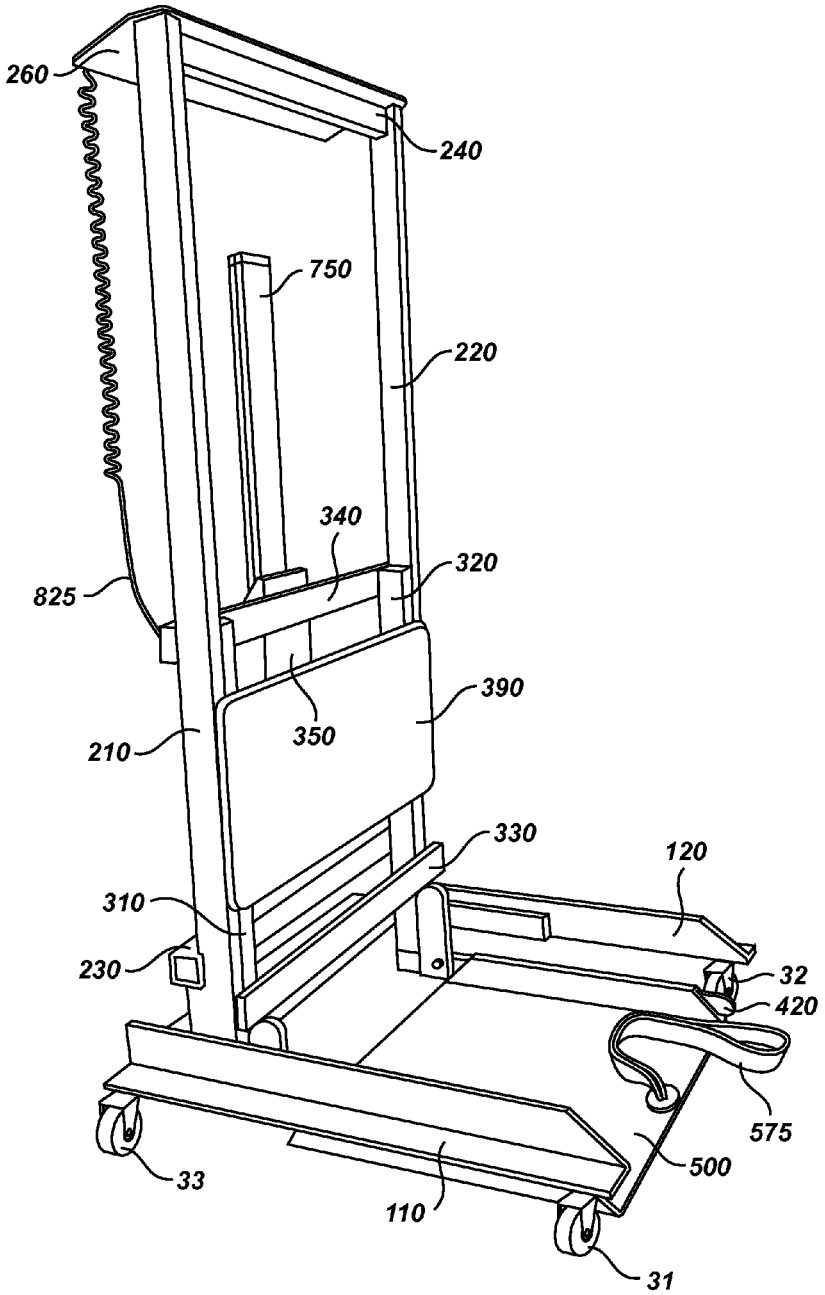
FIG. 2 depicts a perspective view of the lift apparatus shown in FIG. 1 with the seat plate positioned on the floor.

As shown in FIGS. 1 and 2, which depict perspective views of the present invention, the lift apparatus is comprised of a base that includes: a first leg 110, a second leg 120, and a crossbeam 130 that is connected to first leg 110 and second leg 120. Referring to FIGS. 1 and 2 and also to FIG. 3 and FIG. 6 (which depict a back view and side view of the present invention, respectively), first leg 110 is parallel to second leg 120, and crossbeam 130 is connected perpendicularly to first leg 110 and second leg 120. However, in other versions of the invention, first leg 110 and second leg 120 may be configured at alternate positions and unparallel to one another. For instance, first leg 110 and second leg 120 may be attached to crossbeam 130 and configured to form wider or more obtuse angles to accommodate seat plates of larger dimensions and/or alternate shapes. First leg 110, second leg 120, and crossbeam 130 are essentially positioned and configured parallel to the floor to provide stability for the lift apparatus. First leg 110 and second leg 120 each includes a surface to which the vertical assembly can be securely mounted onto. For example, first leg 110 and second leg 120 may each comprise of an angle iron or an L-shaped cross-section that includes a vertical lip that provides sufficient surface area to which the vertical assembly is mounted. This vertical lip runs perpendicular to the floor and provides an attachment point for the vertical assembly. Additionally, a plurality of wheels is attached to the base to position and move the apparatus of the present invention. As seen in FIGS. 1-3 and FIG. 6, wheels 31 and 33 are attached to first leg 110, and wheels 32 and 34 are attached to second leg 120.

The vertical assembly is comprised of (i) a fixed subassembly that remains in a fixed position while the patient is elevated or lowered and (ii) a traveling subassembly that travels vertically (along with the fork system to which it is attached and the seat plate that is attached to the fork system) while the patient is elevated or lowered.

Figure 3:
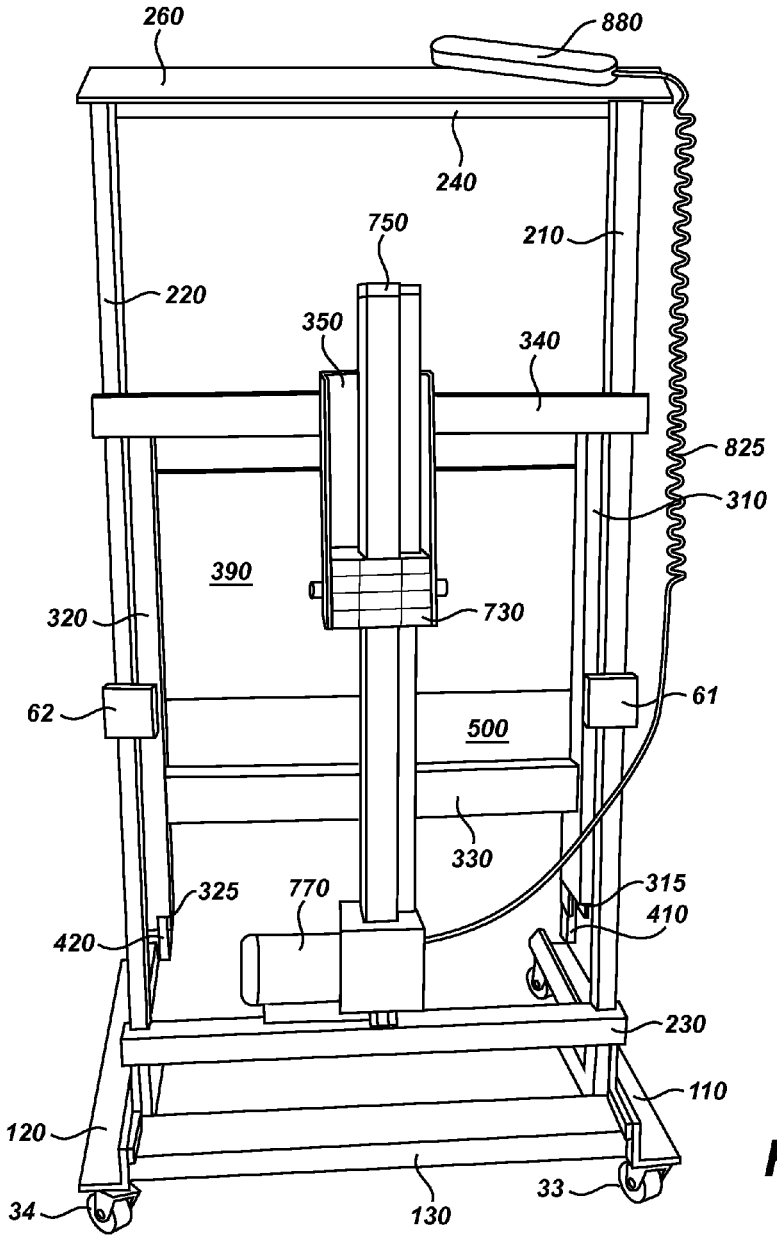
FIG. 3 depicts a back view of the lift apparatus shown in FIG. 1 with the seat plate in a collapsed position.

As illustrated in FIGS. 1-3, the fixed subassembly includes a first vertical member 210, a second vertical member 220 that is parallel to first vertical member 210, and a top crossmember 240 that is connected perpendicularly to first vertical member 210 and second vertical member 220. In some embodiments of the present invention as shown in FIGS. 1-3, the fixed subassembly may further include a lower crossmember 230 that is connected perpendicularly to first vertical member 210 and second vertical member 220, and lower crossmember 230 is configured parallel to top crossmember 240. Lower crossmember 230 may provide an attachment surface for one or more components of the mechanism that powers the vertical movement of the traveling subassembly. For example, as seen in FIG. 1 and FIG. 3, an actuator motor 770 may be mounted to lower crossmember 230. Furthermore, in some versions of the invention as shown in FIGS. 1-3 and in FIG. 6, top crossmember 240 may also include a top member 260 that provides a surface on which controls, switches and/or buttons to control an actuator or other mechanism may be attached. Placement of controls for an actuator or other mechanism on top member 260 allows easy access for the caregiver using the present invention. For instance, as illustrated in FIG. 3, a remote control 880 that controls an actuator may be removably attached (e.g., via VELCRO®) to top member 260. Directions, warnings, notices, and other displays may also be included on top member 260 of the fixed subassembly.

The traveling subassembly is moveably mounted onto the fixed subassembly to allow it to travel vertically upon the fixed subassembly while the patient is mounted onto seat plate 500 and is elevated from or lowered to the floor. The traveling subassembly travels with the fork system to which it is attached and with seat plate 500 that is attached to the fork system. Referring to FIGS. 1-3, the traveling subassembly includes: a first sidebar 310, a second sidebar 320 that is parallel to first sidebar 310, a lower crossbar 330 connected perpendicularly to first sidebar 310 and second sidebar 320, and an upper crossbar 340 that is connected perpendicularly to first sidebar 310 and second sidebar 320 and is parallel to lower crossbar 330. As shown in FIG. 3, first sidebar 310 includes first sidebar bottom 315, and second sidebar 320 includes second sidebar bottom 325. First sidebar bottom 315 and second sidebar bottom 325 help maintain and secure the fork system and seat plate 500 in a horizontal position as further discussed below in regard to FIG. 8.

As depicted in FIGS. 2-3, the traveling subassembly further includes a mount 350 attached to upper crossbar bar 340. The mechanism such as a linear actuator that powers the vertical movement of the traveling assembly is secured to mount 350. For instance, carriage 730 or moving block of a linear actuator may be secured to mount 350 as shown in FIG. 3. The traveling subassembly moves along with carriage 730 as it moves vertically upon track 750 of the actuator. The traveling subassembly may further include a panel 390 on the front side of the traveling subassembly. Panel 390 may protect the user from the moving parts of the lift assembly such as carriage 730 of the actuator by providing a barrier between the user and moving parts. Additionally, the vertical motion of traveling subassembly upon the fixed subassembly may be guided by position glides 61 and 62 as shown in FIG. 3. Position glides 61 and 62 also help secure and maintain the traveling subassembly's position on the fixed subassembly as the traveling subassembly travels vertically upward and downward upon the fixed subassembly.

Figure 4:
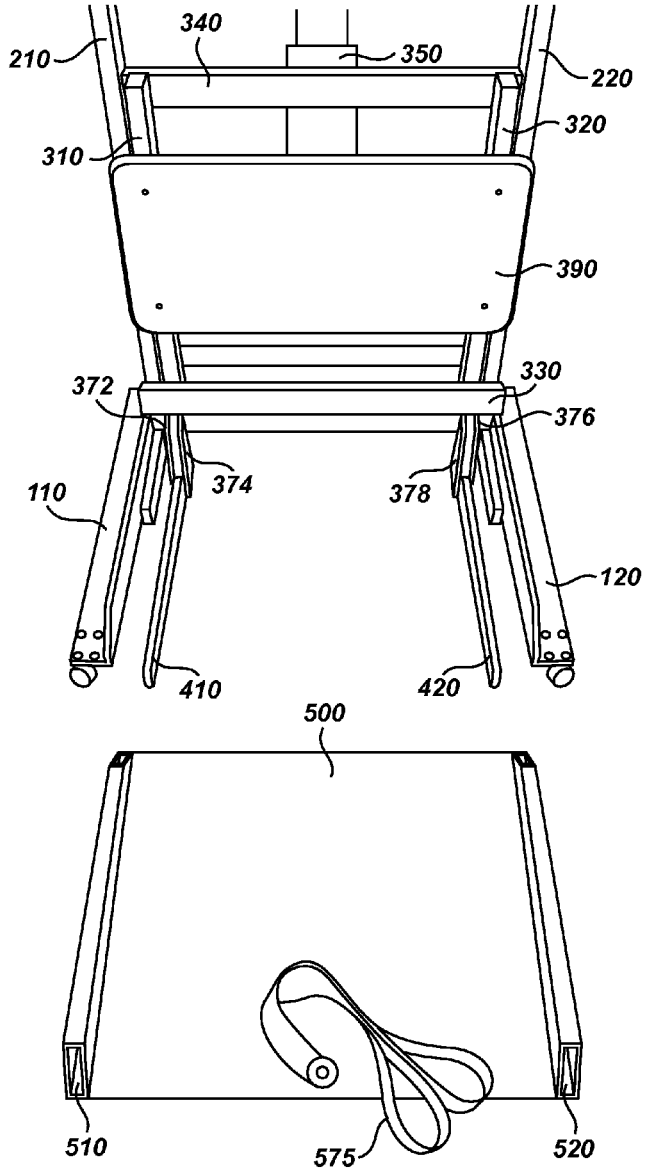
FIG. 4 depicts a front perspective view of the seat plate and fork system of the lift apparatus wherein the seat plate is removed from the fork system and positioned on the floor in accordance with an embodiment of the present invention.

FIG. 4 depicts a front perspective view of seat plate 500 and the fork system of the lift apparatus in which seat plate 500 is removed from the fork system and positioned on the floor. FIG. 4 also illustrates another view of the traveling subassembly including first sidebar 310, second sidebar 320, lower crossbar 330, upper crossbar 340, mount 350, and panel 390. As shown in FIG. 4, the traveling subassembly also includes first fork outer mount 372, a first fork inner mount 374, a second fork outer mount 376, and a second fork inner mount 378.

Figure 5:
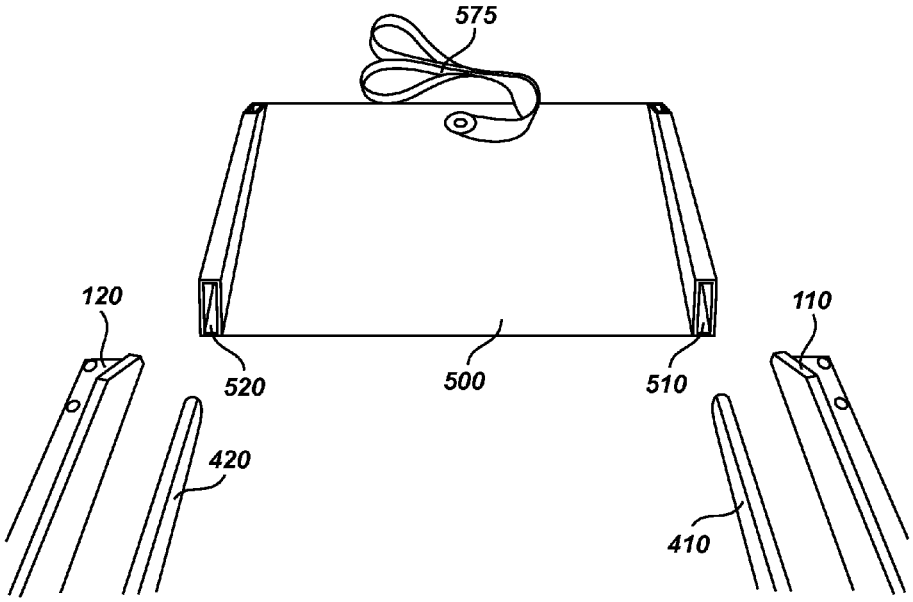
FIG. 5 depicts a rear perspective view of the seat plate and a portion of the fork system illustrated in FIG. 4.

The fork system is attached to the traveling subassembly and extends horizontally from the traveling subassembly. The fork system includes a first fork 410 and a second fork 420 that are parallel to one another. Alternate views of the fork system wherein seat plate 500 is attached to first fork 410 and second fork 420 are also illustrated in FIGS. 1, 3, and 5. First fork 410 is positioned in-between and mounted to first fork outer mount 372 and first fork inner mount 374. Second fork 420 is positioned in-between and mounted to second fork outer mount 376 and second fork inner mount 378. In the version of the invention shown in FIG. 4, first fork 410 and second fork 420 are parallel to first leg 110 and second leg 120 of the base of the lift apparatus.

As seen in FIG. 4, seat plate 500 is flat and is removably attached to the fork system to allow it to be placed onto the floor for the user to mount. Seat plate 500 includes a first channel 510 positioned along one side of seat plate 500 and a second channel 520 that is positioned on the opposite side of seat plate 500. Second channel 520 is positioned parallel to and opposite of first channel 510. Seat plate 500 is substantially flat with the exception that first channel 510 and second channel 520 create slight protrusions along the side edges of seat plate 500. The rigidity, flatness, and smooth surface of seat plate 500 allow it to be easily paced and maneuvered underneath the user while the user mounts seat plate 500. Seat plate 500 is comprised of a rigid material such as a metal with a low coefficient of friction to allow the user to easily slide onto seat plate 500 during the mounting process. The low coefficient of friction of seat plate 500 may also be created by adding a finish, coating, cover, or other low friction material directly onto seat plate 500 in other embodiments of the invention. The rigid material of seat plate 500 is able to sustain the weight of the user and provides stability and support of the user while he/she is moved vertically away from the floor. A strap 575 may be affixed to seat plate 500. The user can hold onto strap 575 for added stability and a sense of security while he/she is being lifted from the floor. Seat plate 500 as well as the base and vertical assembly of the present invention may comprise of any suitable metal material known in the art such as an aluminum or stainless steel.

Referring to FIG. 4 and FIG. 5, which depicts a rear perspective view of seat plate 500 and a portion of the fork system, seat plate 500 is removed from the fork system by pulling seat plate 500 off the fork system to thereby remove first fork 410 from first channel 510 and to remove second fork 420 from second channel 520. Seat plate 500 is then placed onto the floor to allow the user on the floor to mount seat plate 500 as described below in regard to FIGS. 11-13. After the user is mounted onto seat plate 500, seat plate 500 is then reattached to the fork system by maneuvering the lift apparatus via its wheels behind seat plate 500 to a position where first fork 410 aligns directly behind first channel 510 and second fork 420 aligns directly behind second channel 520. The lift apparatus is then maneuvered toward seat plate 500 so that first fork 410 is inserted into first channel 510 and second fork 420 is inserted into second channel 520 to thereby reattach seat plate 500 to the fork system.

Figure 6:
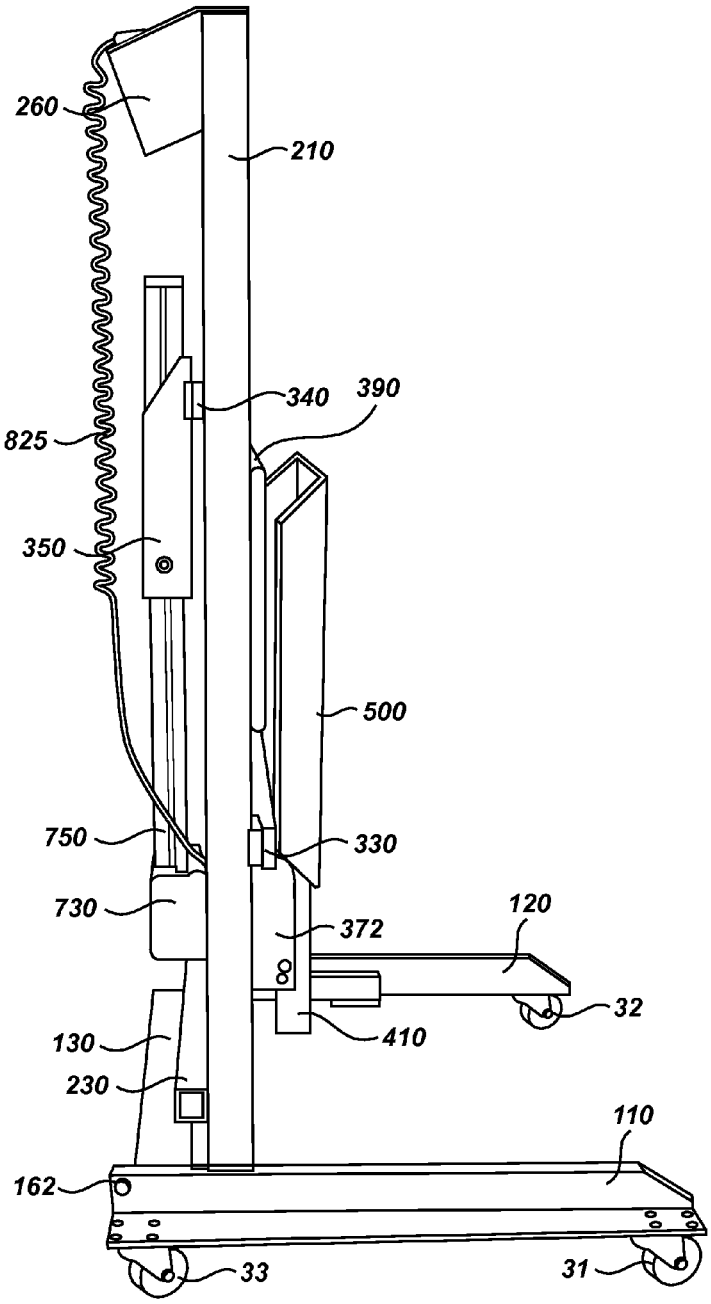
FIG. 6 depicts a side view of the lift apparatus shown in FIG. 1 with the seat plate in a collapsed position.
Figure 7:
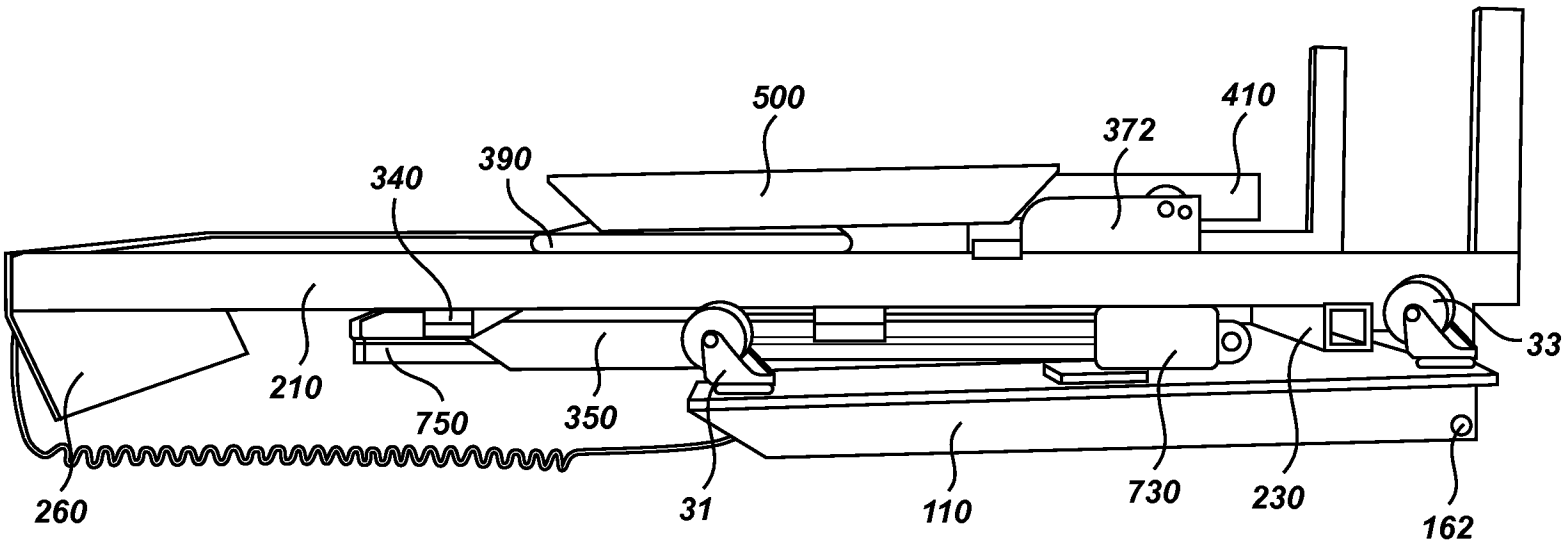
FIG. 7 depicts a side view of the lift apparatus shown in FIG. 1 lying on its backside with the seat plate and base in collapsed positions.

The lift apparatus of the present invention is collapsible for easy storage and transport and has a small footprint so it can be used in healthcare facilities and homes with limited space. FIG. 6 depicts a side view of the lift apparatus of the present invention wherein seat plate 500 is in a collapsed position. FIG. 7 depicts a side view of the lift apparatus lying on its backside with both the base (in which FIG. 7 shows first leg 110 of the base) and seat plate 500 in collapsed positions.

Figure 8:
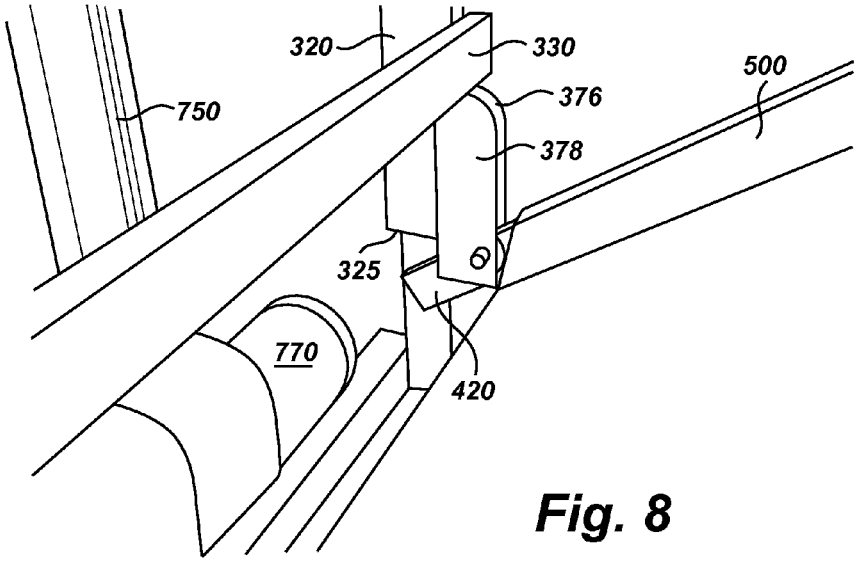
FIG. 8 depicts a perspective view of a portion of the fork system and seat plate of the lift apparatus wherein the seat plate is partially collapsed in accordance with an embodiment of the present invention.

As illustrated in FIG. 8, which depicts a perspective view of a portion of the fork system and seat plate 500 in which seat plate 500 is partially collapsed, the fork system is pivotally attached to the traveling subassembly to allow the lift apparatus to be collapsed. A portion of the traveling subassembly is also illustrated in FIG. 8, which shows second fork outer mount 376 and second fork inner mount 378 attached to lower crossbar 330, which is attached perpendicularly to both second sidebar 320 and first sidebar 310 (see also FIG. 4). Second fork 420 is inserted into second channel 520 of seat plate 500, and second fork 420 is positioned in-between and mounted to second fork outer mount 376 and second fork inner mount 378. Similarly, but not shown in FIG. 8, first fork 410 is inserted into first channel 510 of seat plate 500, and first fork 410 is positioned in-between and mounted to first fork outer mount 372 and first fork inner mount 374 (see also FIG. 4). First sidebar bottom 315 and second sidebar bottom 325 maintain and secure the fork system and seat plate 500 in a horizontal position (see also FIG. 3). As seen in FIG. 8, second sidebar bottom 325 acts as a barrier or stopper to prevent second fork 420 from further rotating downward and keeps second fork 420 in a horizontal position. Correspondingly, but not shown in FIG. 8, first sidebar bottom 315 also acts as a barrier or stopper to prevent first fork 410 from further rotating downward and keeps first fork 410 in a horizontal position.

Figure 9:
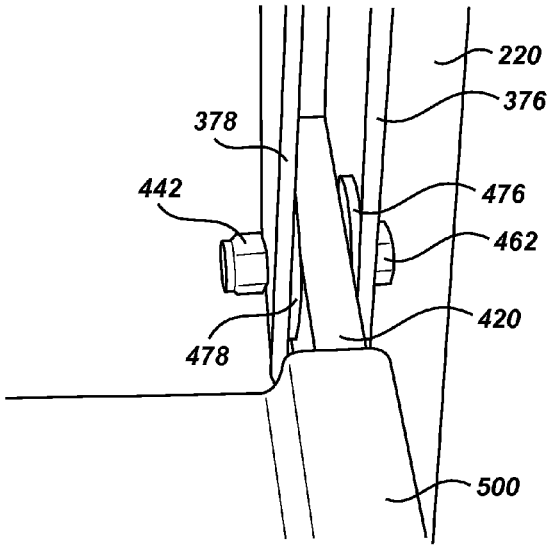
FIG. 9 depicts a close-up perspective view of a portion of the fork system illustrated in FIG. 8.

FIG. 9 depicts a close-up perspective view of a portion of the fork system shown in FIG. 8 and illustrates second fork 420 positioned in-between second fork outer mount 376 and second fork inner mount 378. Second fork 420 is mounted to second fork outer mount 376 and second fork inner mount 378 via a bolt 462 and a locking nut 442. Bolt 462 is inserted through: second fork outer mount 376, second fork outer washer 476, second fork 420, second fork inner washer 478, and second fork inner mount 378. Locking nut 442 locks bolt 462 in place to thereby secure second fork 420 to the traveling subassembly. Second fork outer washer 476 is positioned in-between second fork 420 and second fork outer mount 376, and second fork inner washer 478 is positioned in-between second fork inner mount 378 and second fork 420. The above-described attachment system of the fork system to the traveling subassembly allows the lift apparatus to be collapsed. When seat plate 500 is attached to the fork system, the pivotal attachment of the fork system to the traveling subassembly allows seat plate 500 to be rotated from a horizontal position as shown in FIG. 1 to a vertical position as shown in FIG. 6. When collapsing the lift apparatus of the present invention, seat plate 500 is flipped or rotated upward to a position against the vertical assembly as shown in FIG. 6 wherein seat plate 500 is parallel to the vertical assembly and placed against or alongside panel 390 (see also FIG. 7).

Figure 10:
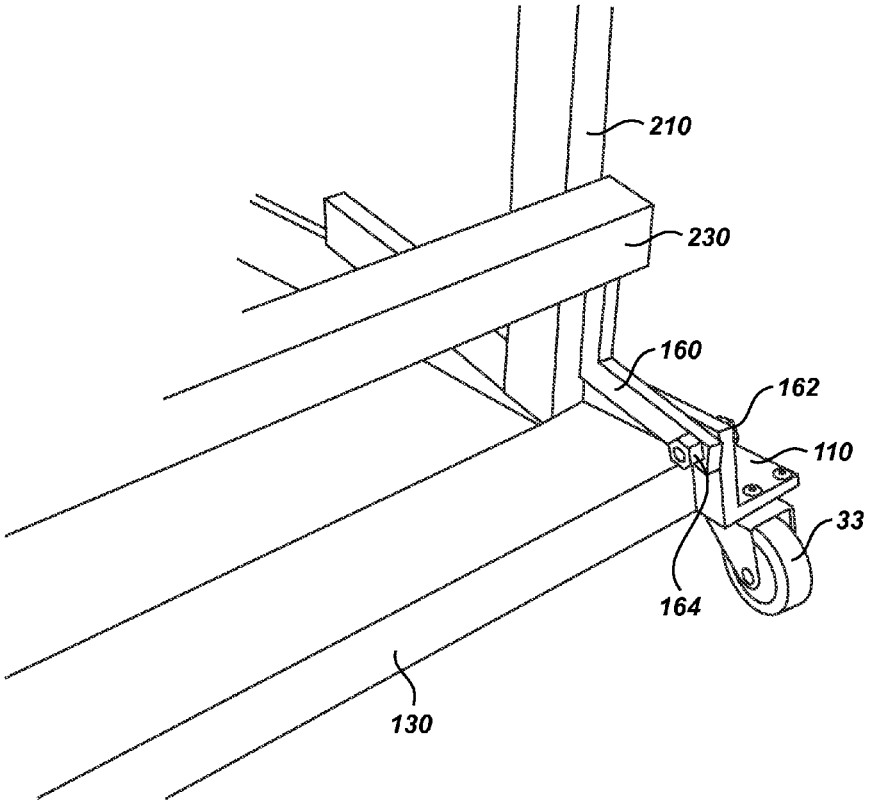
FIG. 10 depicts a rear perspective view of a portion of the base and vertical assembly wherein the base is in a slightly pivoted position in accordance with an embodiment of the present invention.

The base of the lift apparatus may be pivotally adjoined to the fixed subassembly as illustrated in FIG. 10, which depicts a rear perspective view of a portion of the base and vertical assembly wherein the base is in a slightly pivoted position. FIG. 4 shows a portion of lower crossmember 230 and first vertical member 210 of the fixed subassembly. Crossbeam 130 is attached perpendicularly to first leg 110 and second leg 120 (see also FIG. 3) to collectively form the base of the lift apparatus of the present invention. Crossbeam 130 and first leg 110 are collectively attached to first vertical member via a pivot arm 160, a bolt 162 which is inserted through first leg 110 and pivot arm 160, and a nut 164 which secures bolt 162 to pivot arm 160 (see also FIGS. 6-7 for alternate views of bolt 162). Crossbeam 130 and first leg 110 rotate upon pivot arm 160 when being collapsed from a first position that is horizontal and parallel to the floor to a second position that is parallel to the vertical subassembly. For instance, the base may be rotated and swung downward and backward such that the second position of the base is against the backside of the vertical assembly as shown in FIG. 7, which illustrates the lift apparatus of the present invention with both seat plate 500 and the base in collapsed positions. Once collapsed (i.e., seat plate 500 is rotated from a horizontal position to a vertical position against or alongside the front of the vertical assembly and the base is rotated downward to a position against or along the backside of the vertical assembly), the lift apparatus can then easily be stored underneath a bed, in a closet, or against a wall.

The mechanism that powers and facilitates the vertical movement of the traveling subassembly may comprise of any suitable mechanism known in the art that provides vertical movement such as a manual winch and cable. In an alternate embodiment of the invention as shown in FIGS. 1-3 and FIGS. 6-8, the mechanism can comprise of an actuator. As shown in FIG. 3, the actuator may include a carriage 730 or moving block mounted to the traveling subassembly, a track 750 to which the carriage is moveably engaged, and a motor 770 that powers the vertical movement of carriage 730 upon track 750 to lift seat plate 500 from the floor to a higher elevation. The actuator may be controlled by remote control 880 that may be removably attached to an accessible position on the vertical assembly such as on top member 260. Remote control 880 may be removably attached by VELCRO®, by a rack, holder or housing attached to top member 260 that removably retains the remote control 880, or by any other suitable removable attachment/fastening system that includes male-female-type components that inter-engage with one another to removably hold remote control 880. In the version of the invention shown in FIG. 3, remote control 880 includes a cord 825 although in other versions of the invention, remote control 880 may be cordless. Also, in other versions of the invention, the actuator can be controlled by a control panel such as one comprised of switches and/or buttons located on top member 260.

Any suitable actuator known in the art such as a linear actuator or track actuator may be used to power and facilitate the vertical motion of the traveling subassembly and to thereby facilitate the elevation and lowering of seat plate 500. Various actuators with certain specifications relating to stroke length, force, load capacity, and other specifications may be used to accommodate patients of various measurements and weights. As shown in FIG. 3, an example of a linear actuator or track actuator that may be used with the lift apparatus of the present invention is a linear actuator that includes motor 770, track 750, and carriage 730 that is moveably engaged with track 750. Carriage 730 travels up and down track 750. Motor 770 is mounted onto lower crossmember 230, and carriage 730 is secured to mount 350 of the traveling subassembly to thereby facilitate the vertical movement of the traveling subassembly and seat plate 500. As carriage 730 travels up and down track 750, the traveling subassembly travels up and down the fixed subassembly accordingly. In the version of the invention shown in FIG. 3, the actuator has a 20-inch stroke length and has a full load potential of 450 pounds although in alternate versions of the invention, actuators of a variety of other specifications may be used.

Method for Lifting a Person from the Floor

Figure 11:
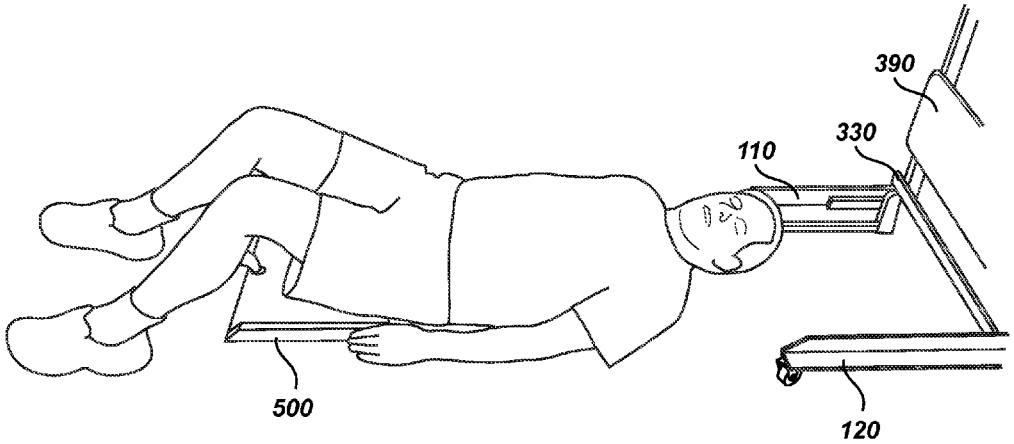
FIG. 11 depicts a user on the floor with the seat plate detached from the lift apparatus and positioned partially underneath the user on the floor.

FIGS. 11-15 illustrate the present invention being used to assist a user on the floor who is unable to get up without assistance. Seat plate 500 is removed from the fork system by removing first fork 410 from first channel 510 and removing second fork 420 from second channel 520 (see also FIGS. 4-5). To accomplish removal of seat plate 500 from the fork system, the caregiver simply slides or pulls seat plate 500 off the fork system. The caregiver then places seat plate 500 partially underneath the user to begin the mounting process. FIG. 11 depicts a user on the floor with seat plate 500 removed from the lift apparatus and positioned partially underneath the user. The rigidity, flatness, and smooth surface of seat plate 500 allow seat plate 500 to be easily maneuvered and slid underneath the user during the mounting process.

Unlike other lift devices in the art, the user can mount seat plate 500 from his/her front side (i.e., the user can mount seat plate 500 while positioned behind seat plate 500) since seat plate 500 does not include a backrest or other back member that would prevent the user from mounting seat plate 500 from his/her front side. In the example depicted in FIGS. 11-15, the user mounts seat plate 500 from his/her front side. However, the user can also mount seat plate 500 from his/her backside (i.e. the user can mount seat plate 500 while positioned in front of seat plate 500) as for example, by maneuvering and scooting backward onto seat plate 500. The method of the user's mounting onto seat plate 500 may depend on the nature of the user's injury, disability or physical limitations.

Figure 12:
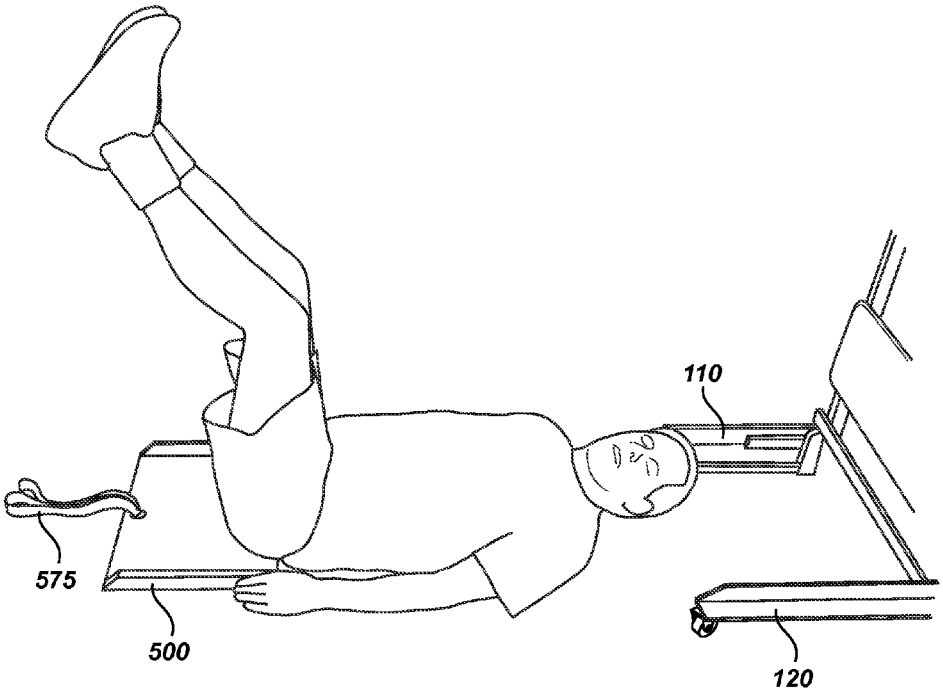
FIG. 12 depicts the user illustrated in FIG. 11 mounting the seat plate of the lift apparatus.

FIG. 12 illustrates the user mounting the seat plate of the lift apparatus. The user must be in an upright seating position on seat plate 500 before he or she can be placed onto the lift apparatus. Therefore, the user may need to use his or her legs (which may be achieved with the assistance of the caregiver) to propel into an upright seating position as shown in FIG. 12. The caregiver may also use other techniques (e.g., pulling the user's arms or guiding the user's back upward) to get the user into an upright seating position on seat plate 500.

Figure 13:
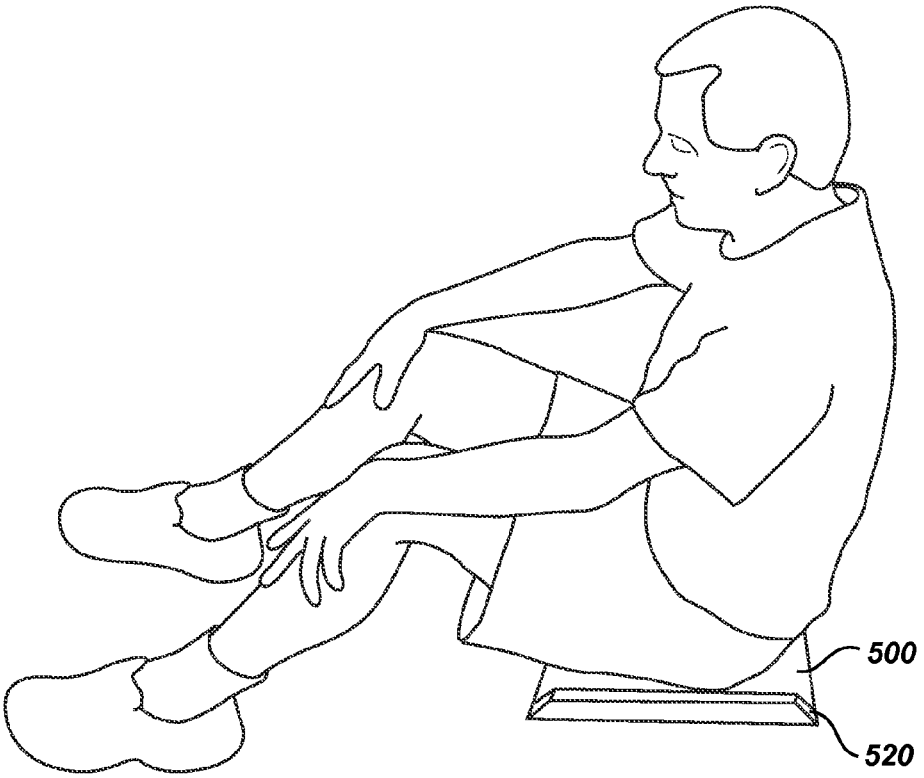
FIG. 13 depicts the user illustrated in FIG. 12 mounted onto the seat plate of the lift apparatus.

FIG. 13 depicts the user mounted onto seat plate 500 of the lift apparatus. At this juncture or at anytime before this juncture, the caregiver should lower the fork system to the floor or lowest possible position by activating the mechanism (e.g., actuator or mechanical winch) that facilitates the vertical movement of the traveling subassembly. The caregiver then reattaches seat plate 500 to the fork system by maneuvering the lift apparatus via its wheels behind seat plate 500 to a position where first fork 410 aligns directly behind first channel 510 of seat plate 500 and where second fork 420 aligns directly behind second channel 520 of seat plate 500. FIG. 5 illustrates a position where first fork 410 aligns directly behind first channel 510 and second fork 420 aligns directly behind second channel 520. The lift apparatus is then maneuvered and pushed toward seat plate 500 so that first fork 410 is fully inserted into first channel 510 and second fork 420 is fully inserted into second channel 520 to thereby reattach and secure seat plate 500 to the fork system of the present invention.

Figure 14:
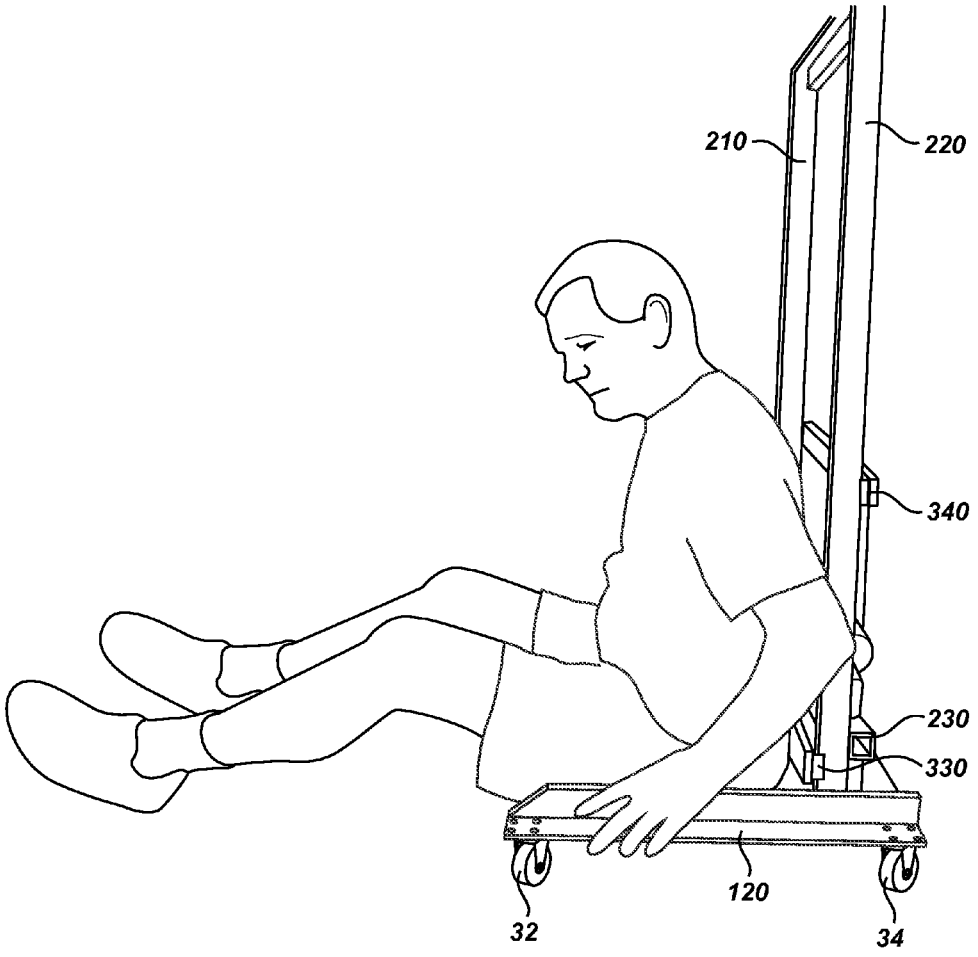
FIG. 14 depicts the user illustrated in FIG. 13 mounted onto the seat plate wherein the seat plate is positioned on the floor and reattached to the lift apparatus.

FIG. 14 depicts the user mounted onto seat plate 500 wherein seat plate 500 is positioned on the floor and reattached to the lift apparatus (i.e., first fork 410 is inserted into first channel 510 of seat plate 500 and second fork 420 is inserted into second channel 520 of seat plate 500). The caregiver then activates the mechanism (via a remote control, control panel or other control device) that facilitates the vertical movement of the traveling subassembly to lift seat plate 500 from the floor to an elevated position.

Figure 15:
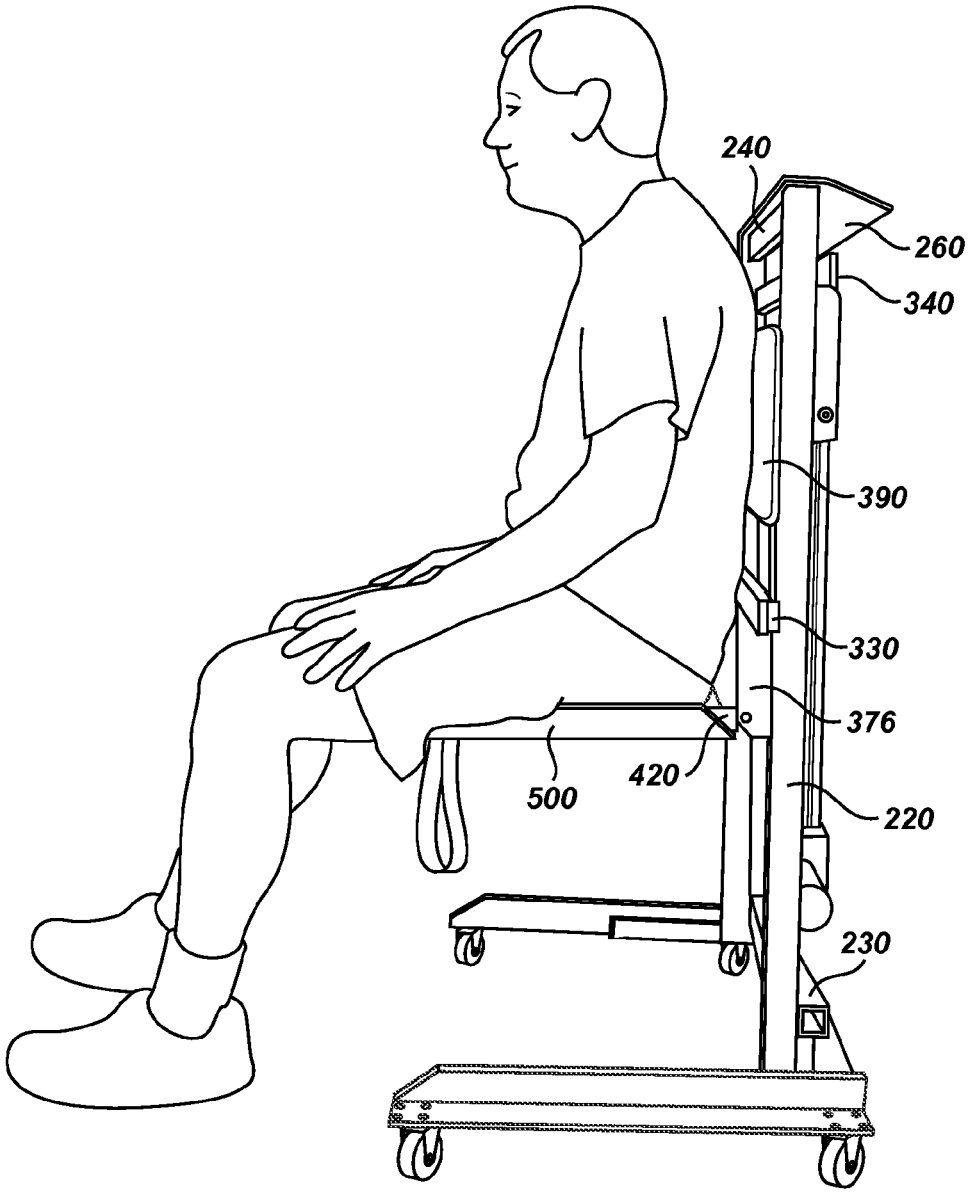
FIG. 15 depicts the user illustrated in FIG. 14 mounted onto the seat plate wherein the seat plate is in an elevated position.

FIG. 15 depicts the user still mounted onto the seat plate wherein seat plate 500 is in an elevated position At this elevated position, the user is able to stand up and/or access a wheelchair or walking aid such as a walker, cane, or crutches. After elevating seat plate 500 to an elevated position and thereby lifting the user from the floor, the caregiver may also have to maneuver, pull and/or push the lift apparatus (with the user still mounted onto seat plate 500) to another area within the healthcare facility or home where the user will be transferred to (e.g., to a bed or sofa) or where the patient can access his/her wheelchair or walking device.

The present invention is directed to a collapsible apparatus that lifts and moves a disabled, injured, or elderly person who is unable to get up on their own after falling to the ground. The invention is intended for use by one caregiver who is unable to lift and/or move a patient (although in rare cases, the patient may use the apparatus on their own without a caregiver (e.g., if the apparatus is close enough for the patient to reach and position).

Accordingly, another aspect of the present invention is directed to a method for lifting a person from the floor, the method comprising: (1) providing a lift apparatus that includes: a base, wheels attached to the base, a vertical assembly comprised of (i) a fixed subassembly and (ii) a traveling subassembly moveably mounted onto the fixed subassembly, a mechanism that facilitates vertical motion of the traveling subassembly, a fork system that is attached to the traveling subassembly, extends horizontally from the traveling subassembly, and includes a first fork and a second fork, and a seat plate that is substantially flat, removably attached to the fork system, and includes a first channel and a second channel that is parallel to the first channel and positioned on the opposite side of the first channel; (2) removing the seat plate from the fork system by removing the first fork from the first channel of the seat plate and by removing the second fork from the second channel of the seat plate; (3) placing the seat plate onto the floor; (4) mounting the user onto the seat plate; (5) lowering the fork system to the floor or to the lowest possible position by activating the mechanism that facilitates the vertical movement of the traveling subassembly; (6) reattaching the seat plate to the fork system by maneuvering the lift apparatus toward the seat plate such that the first fork is fully inserted into the first channel of the seat plate and the second fork is fully inserted into the second channel of the seat plate; and (7) activating the mechanism to lift the seat plate and the user mounted thereon to an elevated position.

With respect to the method of the present invention described above, the order in which the actions are presented below is not limited to any particular order and does not necessarily imply that they have to be performed or occur in the order presented. It will be understood by those of ordinary skill in the art that the order of these actions can be rearranged and performed in any suitable or logical manner. It further will be understood by those of ordinary skill in the art that some actions may be omitted, added, and/or modified and still fall within the spirit of the invention.

Although the present invention has been described above in considerable detail with reference to certain versions thereof, other versions are possible. Many of the elements of the invention may be of alternate suitable shapes, sizes, and/or configurations; may further include structures not described hereinabove; may exclude one or more components described above, and may be positioned at alternate suitable locations within the apparatus without departing from the spirit and scope of the present invention The attached figures depicting certain embodiments of the invention are primarily intended to convey the basic principles embodied in the present invention. Thus, the present invention may further include additional structures and features not illustrated in the figures. Also, the dimensions, shapes, configuration, and/or specifications of various structures and components of the present invention may be modified or customized to accommodate patients of various sizes and weights or to accommodate certain contexts and settings in which the apparatus will be used.

While the description above refers to particular embodiments of the present invention, it will be understood that many modifications may be made without departing from the spirit thereof. The presently disclosed embodiments are therefore to be considered in all respects as illustrative and not restrictive.

What is claimed is:

1. A lift apparatus comprising:
- a base comprised of
  - a first leg,
  - a second leg, and
  - a crossbeam connected to the first leg and the second leg;
- a plurality of wheels attached to the base;
- a vertical assembly comprised of
  - a fixed subassembly adjoined to the base, the fixed subassembly comprising
    - a first vertical member,
    - a second vertical member parallel to the first vertical member, and
    - a top crossmember connected perpendicularly to the first vertical member and the second vertical member, and
  - a traveling subassembly moveably mounted onto the fixed subassembly;
- a mechanism that facilitates vertical motion of the traveling subassembly;
- a fork system that is attached to the traveling subassembly and extends horizontally from the traveling subassembly, the fork system comprising
  - a first fork and
  - a second fork parallel to the first fork; and
- a seat plate that is substantially flat, does not include a back member and is removably attached to the fork system wherein a person can mount the seat plate from his front side while positioned behind the seat plate and the person can mount the seat plate from his backside while positioned in front of the seat plate, the seat plate including
  - a first channel positioned along a first side of the seat plate and
  - a second channel that is parallel to the first channel and positioned along a side of the seat plate that is opposite the first side wherein the seat plate is removed from the fork system and placed onto a floor to allow the person on the floor to mount the seat plate and wherein the seat plate is attached to the fork system by inserting the first fork into the first channel and inserting the second fork into the second channel and the mechanism is activated to lift the person from the floor.

2. The lift apparatus of claim 1 wherein the traveling subassembly is comprised of
- a first sidebar,
- a second sidebar parallel to the first sidebar,
- a lower crossbar connected perpendicularly to the first sidebar and the second sidebar, and
- an upper crossbar connected perpendicularly to the first sidebar and the second sidebar.

3. The lift apparatus of claim 1 wherein the fork system is pivotally attached to the traveling subassembly and the apparatus is collapsed when the seat plate is attached to the fork system by rotating the seat plate from a horizontal position to a vertical position.

4. The lift apparatus of claim 3 wherein the base is pivotally adjoined to the fixed subassembly and the apparatus is further collapsed by rotating the base from a first position parallel to the floor to a second position parallel to the vertical subassembly.

5. The lift apparatus of claim 1 wherein the mechanism is comprised of an actuator.

6. The lift apparatus of claim 5 wherein the actuator is comprised of a motor, a track and a carriage that is moveably engaged with the track.

7. The lift apparatus of claim 5 wherein the actuator is controlled by a remote control.

8. The lift apparatus of claim 1 wherein the mechanism is comprised of a manual winch and a cable.

9. An apparatus for lifting a person from a floor comprising:
- a base comprised of
  - a first leg,
  - a second leg parallel to the first leg, and
  - a crossbeam connected perpendicularly to the first leg and the second leg
- a plurality of wheels attached to the base;
- a vertical assembly comprised of
  - a fixed subassembly comprising
    - a first vertical member,
    - a second vertical member parallel to the first vertical member wherein the base is pivotally adjoined to the first vertical member and the second vertical member, and
    - a top crossmember connected perpendicularly to the first vertical member and the second vertical member, and
  - a traveling subassembly moveably mounted onto the fixed subassembly, the traveling subassembly comprising
    - a first sidebar,
    - a second sidebar parallel to the first sidebar,
    - a lower crossbar connected perpendicularly to the first sidebar and the second sidebar, and
    - an upper crossbar connected perpendicularly to the first sidebar and the second sidebar;
- a mechanism that facilitates vertical motion of the traveling subassembly;
- a fork system that is pivotally attached to the traveling subassembly and extends horizontally from the traveling subassembly, the fork system comprising
  - a first fork and
  - a second fork parallel to the first fork; and
- a seat plate that is substantially flat, does not include a back member and is removably attached to the fork system wherein the person can mount the seat plate from his front side while positioned behind the seat plate and the person can mount the seat plate from his backside while positioned in front of the seat plate, the seat plate including
  - a first channel positioned along a first side of the seat plate and
  - a second channel positioned along a side of the seat plate that is opposite the first side wherein the seat plate is removed from the fork system and placed onto the floor to allow the person on the floor to mount the seat plate, wherein the seat plate is attached to the fork system by inserting the first fork into the first channel and inserting the second fork into the second channel and the mechanism is activated to lift the person from the floor, and wherein the apparatus is collapsed by rotating the seat plate and the base from horizontal positions to vertical positions.

10. The apparatus of claim 9 wherein the fixed subassembly further comprises a lower crossmember connected perpendicularly to the first vertical member and the second vertical member.

11. The apparatus of claim 10 wherein the traveling subassembly further comprises a mount affixed to the upper crossbar.

12. The apparatus of claim 9 wherein the mechanism is comprised of a linear actuator.

13. The apparatus of claim 11 wherein the mechanism is comprised of an actuator comprising a motor, a track, and a carriage moveably engaged with the track wherein the motor is mounted to the lower crossmember and the carriage is fastened to the mount.

14. The apparatus of claim 9 further comprising a strap affixed to the seat plate.

15. The apparatus of claim 9 wherein the base is rotated downward to position the base against a backside of the vertical assembly when the apparatus is collapsed.

16. An apparatus for lifting a person from a floor comprising:

a base comprised of
- a first leg,
- a second leg parallel to the first leg, and
- a crossbeam connected perpendicularly to the first leg and the second leg a plurality of wheels attached to the first leg and the second leg;

a vertical assembly comprised of
- a fixed subassembly comprising
  - a first vertical member,
  - a second vertical member parallel to the first vertical member,
  - a lower crossmember connected perpendicularly to the first vertical member and the second vertical member, and
  - a top crossmember connected perpendicularly to the first vertical member and the second vertical member, and
- a traveling subassembly moveably mounted onto the fixed subassembly, the traveling subassembly comprising
  - a first sidebar,
  - a second sidebar parallel to the first sidebar,
  - a lower crossbar connected perpendicularly to the first sidebar and the second sidebar,
  - an upper crossbar connected perpendicularly to the first sidebar and the second sidebar, and
  - a mount affixed to the upper crossbar;

an actuator that facilitates vertical motion of the traveling subassembly;

a fork system that is attached to the traveling subassembly and extends horizontally from the traveling subassembly, the fork system comprising
- a first fork and
- a second fork parallel to the first fork; and a seat plate that is substantially flat, does not include a back member and is removably attached to the fork system wherein the person can mount the seat plate from his front side while positioned behind the seat plate and the person can mount the seat plate from his backside while positioned in front of the seat plate, the seat plate including
- a first channel positioned along a first side of the seat plate and
- a second channel positioned along a side of the seat plate that is opposite the first side wherein the seat plate is removed from the fork system and placed onto the floor to allow the person on the floor to mount the seat plate and wherein the seat plate is attached to the fork system by inserting the first fork into the first channel and inserting the second fork into the second channel and the actuator is activated to lift the person from the floor.

17. The apparatus of claim 16 wherein the actuator is comprised of a motor, a track, and a carriage moveably engaged with the track wherein the motor is attached to the lower crossmember and the carriage is fastened to the mount.

18. The apparatus of claim 16 wherein the fork system is pivotally attached to the traveling subassembly to permit repositioning of the seat plate when attached to the fork system from a horizontal position to a vertical position to collapse the apparatus.

19. The apparatus of claim 18 wherein the base is pivotally adjoined to the first vertical member and to the second vertical member to permit repositioning of the base from a first position parallel to the floor to a second position parallel to the vertical subassembly to further collapse the apparatus.

20. The apparatus of claim 19 wherein the base is repositioned by rotating the base downward wherein the second position is behind the vertical assembly.

* * * * *